US007017198B2

(12) United States Patent
Conn et al.

(10) Patent No.: US 7,017,198 B2
(45) Date of Patent: Mar. 28, 2006

(54) POTTY PROTECTOR URINE SHIELD WITH CENTERED TARGETS

(76) Inventors: Donna Fair Conn, 20306 Seabrook Dr., Montgomery Village, MD (US) 20886; William Edward Conn, 20306 Seabrook Dr., Montgomery Village, MD (US) 20886

( * ) Notice: Subject to any disclaimer, the term of this patent is extended or adjusted under 35 U.S.C. 154(b) by 14 days.

(21) Appl. No.: 11/074,537

(22) Filed: Mar. 8, 2005

(65) Prior Publication Data

US 2005/0198727 A1 Sep. 15, 2005

Related U.S. Application Data

(60) Provisional application No. 60/521,226, filed on Mar. 15, 2004.

(51) Int. Cl.
*E03D 9/00* (2006.01)

(52) U.S. Cl. ..... 4/300.3; 4/DIG. 5; 4/661

(58) Field of Classification Search ..... 4/300.3, 4/DIG. 5, 661

See application file for complete search history.

(56) References Cited

U.S. PATENT DOCUMENTS

| | | | | | |
|---|---|---|---|---|---|
| 2,801,424 | A * | 8/1957 | Mercer | 4/661 |
| 4,044,405 | A * | 8/1977 | Kreiss | 4/661 |
| 5,117,512 | A * | 6/1992 | Bressler | 4/300.3 |
| 5,165,694 | A * | 11/1992 | Kraushaar | 273/343 |
| D369,856 | S * | 5/1996 | Lucido et al. | D23/310 |
| 5,671,485 | A * | 9/1997 | Middlestead | 4/661 |
| 6,068,488 | A * | 5/2000 | Sinsheimer et al. | 434/251 |
| 6,357,055 | B1 * | 3/2002 | Gambla et al. | 4/300.3 |
| 6,385,785 | B1 * | 5/2002 | Linden | 4/300.3 |
| 6,550,075 | B1 * | 4/2003 | Brannon, III | 4/300.3 |
| 2005/0077682 | A1 * | 4/2005 | Trecartin | 273/343 |

* cited by examiner

*Primary Examiner*—Khoa D. Huynh

(57) ABSTRACT

A flexible protector urine shield when flat is rectangular-shaped with rounded corners at the top. A handle on the protector shield provides easy of use when placing and removing shield. It mounts with front and back support rods, which lie on top of the rim. The front rod allows for targets to be placed in the center of the toilet to train boys to aim more efficiently.

6 Claims, 3 Drawing Sheets

POTTY PROTECTOR URINE SHIELD WITH CENTERED TARGETS

CROSS-REFERENCE TO RELATED APPLICATIONS

This application claims benefit of 60/521,226 Mar. 15, 2004

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The potty protector is a device used to shield urine from getting outside the toilet when in use and provides a centered target to train boys. There have been a myriad of devices attempting to resolve this issue, but fall short in one or more of the following areas: ease of use, simplified mounting, support for both the back and front of the shield, safe rounded corners, centered and creative targets, and the ability to clean device easily.

With regards to ease of use, the device should be easy to handle, install, remove and clean. Often boys need to urgently use the toilet, so it is important to install the device quickly to avoid an even bigger mess. The following prior art does not provide this handling functionality: U.S. Pat. No. 6,385,785 issued to Linden on May 14, 2002; U.S. Pat. No. 5,983,410 issued to Webster on Nov. 16, 1999; U.S. Pat. No. 5,117,512 issued to Bressler on Jun. 2, 1992; U.S. Pat. No. 3,071,778 issued to Renshaw in January 1963 and U.S. Pat. No. 2,583,718 issue to Walls in January 1952.

Prior art strategies are restrictive requiring exact positioning, complicated mounting, and the use of such devices as clamps, clips, hooks, flanges and suctions cups that make installation of a device very cumbersome. The following patents use clamps: U.S. Pat. No. 2,583,718 issued to Walls in January 1952 and U.S. Pat. No. 4,060,859 issued to Anderson in December 1977. Clamps require exact positioning and a lot of handling to install. The following patents use clips or hooks: U.S. Pat. No. 3,931,649 issued to Jankowski in January 1976, U.S. Pat. No. 5,117,512 issued to Bressler on Jun. 2, 1992; and U.S. Pat. No. 6,385,785 issued to Linden on May 14, 2002 discloses a toilet shield mounted with a back clip, which requires the raised toilet seat to be at a particular angle to hook onto. Not all raised toilet seats are at the same vertical angle with respect to the horizontal plane of the curve top rim of a standard toilet, therefore the back clip on shield may not accommodate the various toilet designs. Also the weight of the toilet seat plus the weight of the clip on toilet shield may cause the seat to fall down. The flange technique is used in the following patents: U.S. Pat. No. D394900 issued to Tae Cho Kang on Jun. 2, 1998 and U.S. Pat. No D405,168 issued to Henry on Feb. 2, 1999.

The prior art only offers one support in one of the two areas. Only providing one area of support will cause the device to sag in the other area. The following patent provides only one area of support: U.S. Pat. No. 6,385,785 issued to Linden on May 14, 2002.

The following patents have sharp corners, which could prove harmful to users: U.S. Pat. No. 6,385,785 issued to Linden on May 14, 2002; U.S. Pat. No. 5,983,410 issued to Webster on Nov. 16, 1999; and U.S. Pat. No. 5,373,589 issued to Rego et al in December 1994.

Other art either does not provide a target or the position of the target is not in the center of the toilet. The following patents position targets ineffectively: U.S. Pat. No. 6,385,785 issued to Linden on May 14, 2002 positions it target at the back and high on the toilet. U.S. Pat. No. 5,117,512 issued to Bressler on Jun. 2, 1992 positions his targets high on his shield, so when the shield is eventually removed they have been trained to aim at the raised toilet seat.

The apparatus should be easy to clean. Other arts use accordion material, which will be extremely difficult to keep clean and sanitary. The following patents would be difficult to keep clean: U.S. Pat. No. 5,373,589 issued to Rego et al in December 1994 and U.S. Pat. No. 5,276,925 issued to Blaha in January 1994.

It is desirable that the installation or mounting of the device be user friendly. The installation of the device should be quick and secure to ensure urine will not spray outside of the toilet bowl.

BRIEF SUMMARY OF THE INVENTION

The potty protector invention is a user-friendly flexible shield, which prevents urine from going outside of the toilet and provides centered targets for toilet training boys. Advantages are the present invention include that it is easy to handle and can be installed quickly. It is a portable solution so those individuals in a family or group not requiring the device can easily remove it and set it aside. It shields urine from splashing on to the floor and around the outside of the toilet. It provides a centralized target for training boy to improve their aim. The targets make the potty training experience fun or game like, thereby encouraging boys to improve their aim while urinating into the toilet. The shield is easy to clean and it can be conveniently stored on a holder next to the toilet for easy access. The holder will support the shield and collect any drippings from the shield after use to help keep the toilet area clean and sanitary.

DETAILED DESCRIPTION OF THE INVENTION

Figure 1:
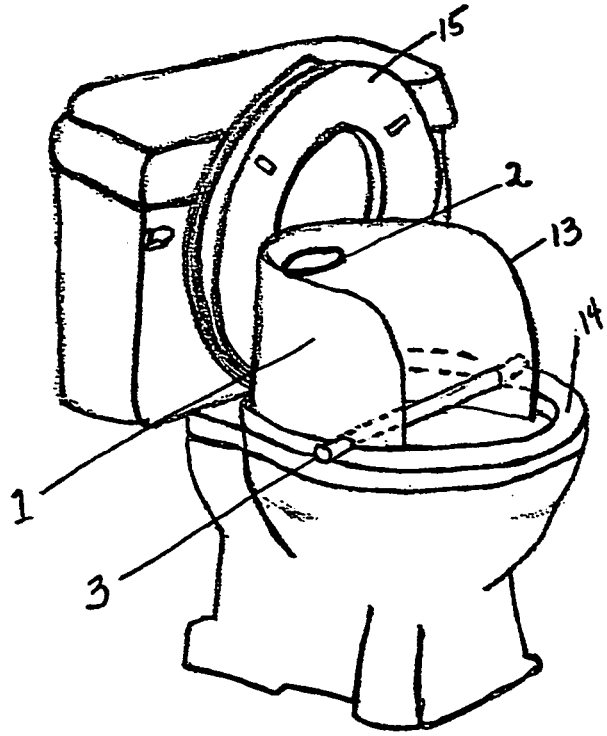
FIG. 1. is a perspective view from the side and front, showing how the front support rod mounts the protector urine shield on the toilet rim.

Referring to the drawings, FIGS. 1 though 6, FIG. 1 shows the potty protector urine shield 1 inside a conventional toilet bowl. The potty protector urine shield 1 is made of smooth plastic, which ensures its flexible to fit inside of the toilet rim 14. The potty protector urine shield 1 has a convenient handle 2 located at the top to aid in the placement and removal of the urine shield. The flexible shield also has a first and second pair of apertures being located on the flexible shield in the same vertical plane, the first pair of apertures having an outer distance there between being of greater distance than an inner distance of the second pair of apertures.

Figure 2:
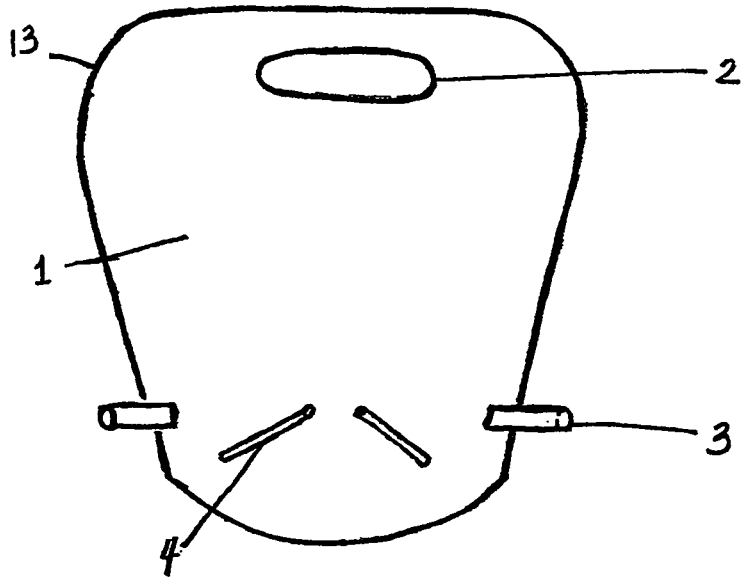
FIG. 2. is a back view of the protector urine shield, showing the back face of the shield and the back and front support rods.

FIG. 2 shows the backside of the potty protector urine shield 1. Two circular rods mount the potty protector urine shield 1. The front support rod 3 extends across the front of the urine shield through the first pair of apertures, traversing the front face of the flexible shield, and lies on top of the rim of the toilet 14. It does not require exact positioning. The use of a circular rod ensures urine will roll off easily. The back support rod 4 mounts the back portion of the potty protector urine shield 1. The back support rod 4 is being inserted through the second pair of aperture, traversing the front surface of the flexible shield, lies on top of the rim and it can be placed between the hinges or outside a center hinge, wherein the removable back support rod being malleable and having second opposite ends pass through the second pair of apertures. The second opposite ends extend away from the back face of the flexible shield forming a U-shape with the back face of the shield. Because the potty protector urine shield 1 provides support for both the front and the back of the protector shield, the device is very stable. The present invention is very reliable and is easy to mount, which is necessary when it is time to use the device. This mounting strategy allows the potty protector urine shield 1 flexibility to fit the various toilet designs more efficiently.

Figure 3:
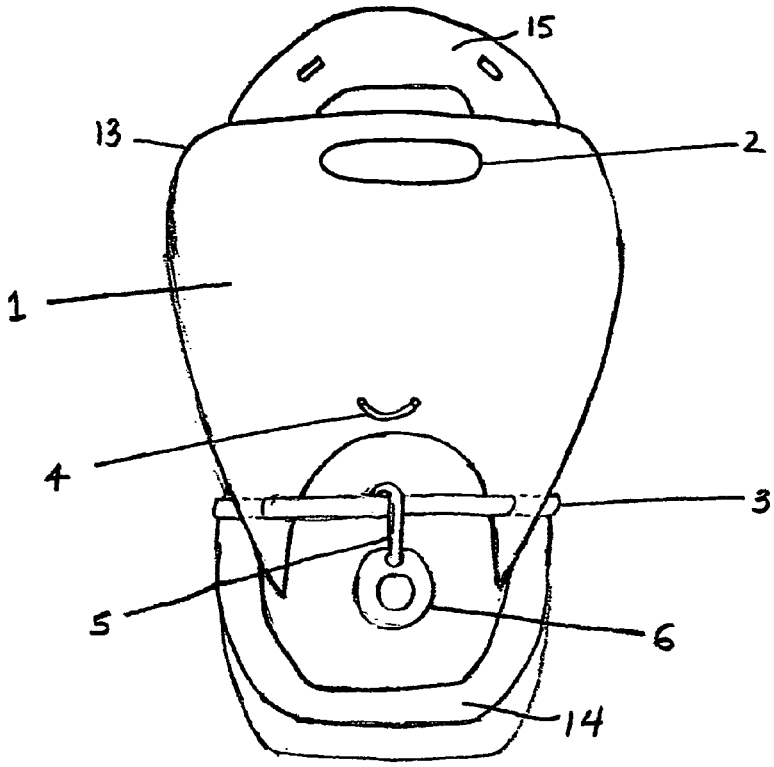
FIG. 3. is a front view of the protector urine shield, showing the handle at the top, the back and front support rods, and a centered ring target.

FIG. 3. shows the front view of the potty protector urine shield with a ring target 6. The potty protector urine shield 1 covers a wide area in front of the raised toilet seat 15. The front support rod 3 supports the front section of the urine shield by lying on top of the toilet rim 14. Clips, screws, etc. do not confine the front support rod 3. There are safe rounded corners 13 on the shield. These rounded corners 13, as opposed to sharp corners, provide a safer device, which will be used, in large part by children.

Figure 4:
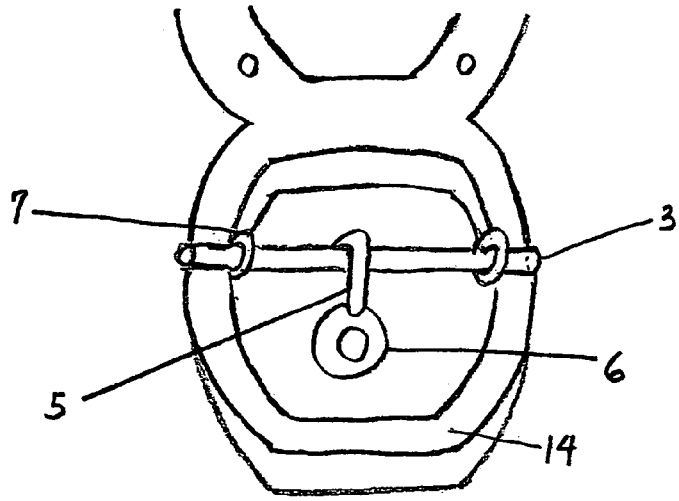
FIG. 4. is a front view of the stand-alone rod, showing the inside fasteners, along with a centered ring target.

FIG. 4 shows a stand-alone rod 3 with a ring target 6. Older males who need target practice would use the stand-alone rod. The stand-alone rod 3 lies across the toilet rim 14. It is secured in places with flexible fasteners 7 inside the toilet rim 14.

The present invention is a device to train boys to use the toilet/potty correctly. The front support rod 3 positions the target in an optimal location, the center of the toilet and above the water in the toilet. Currently, the present invention has a paddle wheel target and a ring target.

Figure 5:
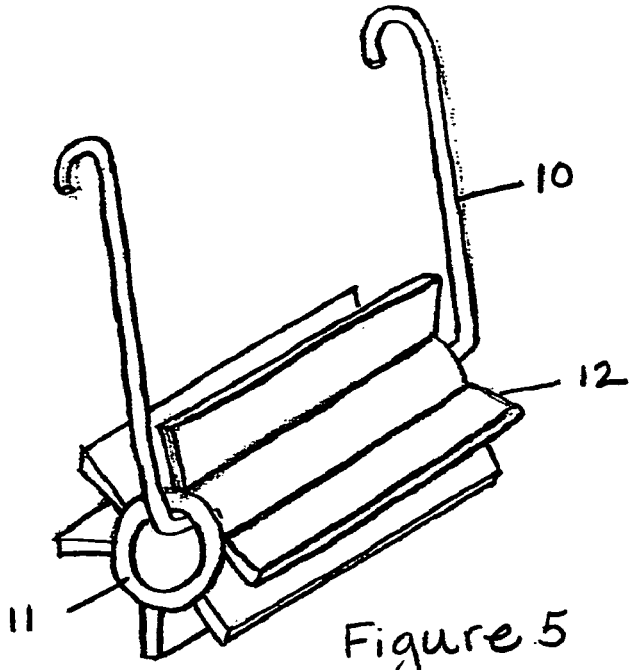
FIG. 5. is a side view of the paddle wheel target and the double hook system used to attach to the front support rod or a stand-alone rod.

FIG. 5 is the paddle wheel target, which is comprised of a double hook attachment 10 for the front support rod 3, a circular tube 11, and flaps 12. The paddle wheel target spins when a steady stream of urine hits it.

Figure 6:
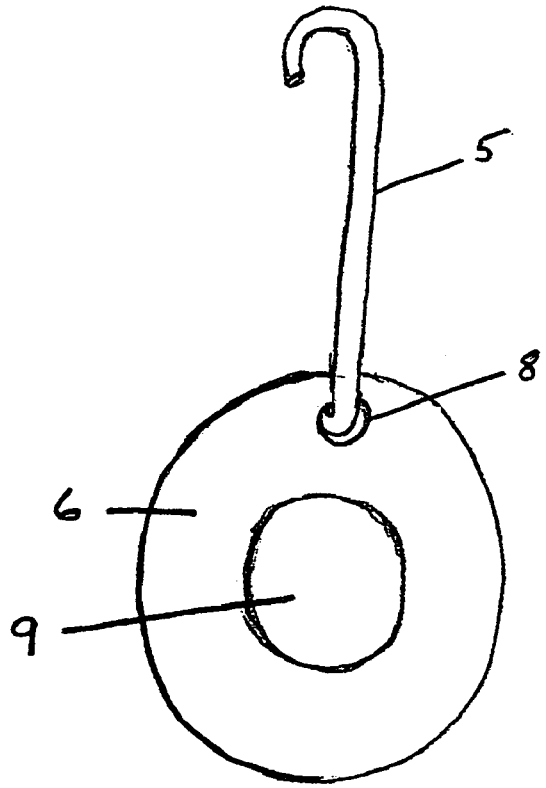
FIG. 6. is a frontal view of the ring target and the single hook system used to attach to the front support rod or a stand-alone rod.

FIG. 6 is the ring target, which comes in a variety colors. This target has an aperture in the center 9 of the ring target 6 in which urine is to go through. There is a smaller aperture at the top 8 of the circular target 6 to accommodate the single hook 5. The single hook 5 is attached to the front support rod 3.

The potty protector urine shield 1 is produced from a very smooth material. This allows the device to be cleaned easily by spraying with a disinfectant and simply wiping clean.

The potty protector urine shield 1 can be easily installed, removed, cleaned and conveniently stored beside the toilet or under the sink in the bathroom.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

The invention claimed is:

1. A potty protector urine shield for use with a toilet bowl, said toilet bowl having a curved top rim, a curved interior rim with a back, front, and sides, water, and a toilet seat that can be raised and lowered, the improvement comprising (a) a flexible shield that conformingly bends along the back and sides of the interior rim, said flexible shield having a top boundary, a bottom boundary, and two side boundaries, a vertical plane, a horizontal plane, a front face and a back face, said vertical plane extending from below the curved interior rim of the toilet bowl to a distance above the curved interior rim of the toilet bowl, and said horizontal plane of the flexible shield curving along the back and sides of the interior rim of the toilet bowl;

(b) at least one aperture near the top boundary of the flexible shield, said at least one aperture forming a handle for placement and removal of the flexible shield from said curved top rim of the toilet bowl;

(c) a first and second pair of apertures being located on the flexible shield in the same vertical plane, said first pair of apertures having an outer distance there between being of greater distance than an inner distance of said second pair of apertures;

(d) a removable front support rod, being inserted through said first pair of apertures having said outer distance there between, traversing the front face of the flexible shield, wherein said removable front support rod passing through said first pair of apertures extends a distance away from the front face of the flexible shield that curves along the back and sides of the interior rim of the toilet maintaining an arcuate shape of the flexible shield and said removable front support rod having first opposite ends extending from the back face of the flexible shield through said first pair of apertures contacting the curved top rim to support the flexible shield;

(e) a removable back support rod, being inserted through said second pair of apertures having said inner distance there between, traversing the front face of the flexible shield, wherein said removable back support rod being malleable and having second opposite ends pass through the second pair of apertures and said second opposite ends extend away from the back face of the flexible shield forming a U-shape with the back face of the flexible shield being a base of the U-shape and said second opposite ends of said removable back support rod interfaces with the curved top rim; and (f) a removable target device being attached to the front support rod.

2. A protector urine shield according to claim 1, comprising a mounting system for the flexible shield to the toilet bowl, said toilet bowl having a pair of hinges at the rear of the toilet bowl connecting the toilet seat to the curved top rim, wherein the first opposite ends of the front support rod extend through the first pair of apertures from the back face of the flexible shield to rest on opposite sides of the curved top rim of the toilet bowl and the second opposite ends of the back support rod being inserted between the pair of hinges and under the raised toilet seat located at the rear of the toilet bowl thereby positioning the flexible shield with the bottom boundary below the curved top rim and the top boundary above the curved top rim.

3. A protector urine shield according to claim 1, wherein the target device is positioned centrally along the front support rod and centrally to the sides of the curved interior rim of the toilet bowl, below the curved interior rim of the toilet bowl, and above a water level contained in the toilet bowl.

4. A protector urine shield according to claim 2, wherein the target device is a rotatable paddle wheel.

5. A protector urine shield according to claim 2, wherein the target device is a ring.

6. A protector urine shield according to claim 1, wherein the target device is used to provide a target to direct aim of the urine stream.

* * * * *